US007007977B1

(12) United States Patent
Gallagher

(10) Patent No.: US 7,007,977 B1
(45) Date of Patent: Mar. 7, 2006

(54) SLIDE PLATE FOR SKATEBOARD RISER PADS

(76) Inventor: Peter J. Gallagher, 8837 E. Kalil Dr., Scottsdale, AZ (US) 85260

( * ) Notice: Subject to any disclaimer, the term of this patent is extended or adjusted under 35 U.S.C. 154(b) by 103 days.

(21) Appl. No.: 10/439,801

(22) Filed: May 16, 2003

Related U.S. Application Data

(60) Provisional application No. 60/381,477, filed on May 17, 2002.

(51) Int. Cl.
*A63C 3/00* (2006.01)

(52) U.S. Cl. ..... 280/809; 280/11.27; 280/87.042

(58) Field of Classification Search ..... 280/87.01, 280/87.021, 87.03, 87.042, 87.043, 11.27, 280/11.28, 809, 816

See application file for complete search history.

(56) References Cited

U.S. PATENT DOCUMENTS

| | | | | |
|---|---|---|---|---|
| 4,076,265 | A * | 2/1978 | Eash, II | 280/87.042 |
| 4,165,090 | A * | 8/1979 | Feddersohn et al. | 280/87.042 |
| 4,185,847 | A * | 1/1980 | Johnson | 280/87.042 |
| 5,100,161 | A * | 3/1992 | Tillyer | 280/87.042 |
| 5,263,725 | A * | 11/1993 | Gesmer et al. | 280/11.28 |
| 5,655,785 | A * | 8/1997 | Lee | 280/11.223 |
| 5,879,013 | A * | 3/1999 | Shih | 280/11.28 |
| 5,971,411 | A * | 10/1999 | Jones et al. | 280/87.042 |
| 6,199,880 | B1 * | 3/2001 | Favorito et al. | 280/87.042 |
| 6,443,471 | B1 | 9/2002 | Mullen | |
| 6,648,345 | B1 * | 11/2003 | Lee | 280/11.27 |
| 6,648,372 | B1 * | 11/2003 | Ojeda, III | 280/809 |
| 2003/0155733 | A1 * | 8/2003 | Tan et al. | 280/87.042 |

* cited by examiner

*Primary Examiner*—Christopher Ellis
*Assistant Examiner*—Brian Swenson
(74) *Attorney, Agent, or Firm*—Frank J. McGue

(57) ABSTRACT

A slide plate having a front slide piece is adapted to engage the outboard side of a skateboard truck. The front slide piece is made from a hard material adapted to slide over an obstacle surface and to protect the outboard surface of the skateboard truck from damage and by adding distance, keep soft wheels from contact with obstacles during maneuvers.

9 Claims, 3 Drawing Sheets

SLIDE PLATE FOR SKATEBOARD RISER PADS

RELATED APPLICATION

This application is a continuation-in-part of provisional application Ser. No. 60/381,477 filed May 17, 2002.

TECHNICAL FIELD

This invention relates generally to the field of skateboard riser pads, and, more particularly, to slide plate for use with skateboard riser pads.

BACKGROUND OF THE INVENTION

Skateboarding is a relatively new sport which has grown in popularity over the years. The first skateboards were simply comprised of roller skating wheels affixed to a piece of wood such as a two by four. In the 1950s, modifications were made to trucks which attach the wheels to the board allowing more maneuverability. By 1959, the first Roller Derby Skateboard was offered for sale and the activity began to climb in popularity, particularly among the surfer crowd. The 1960s saw the introduction of the first professional boards by Makaha as well as the entry of the Hobie skateboard. During this time frame, the first competitions were held, the first skateboard theme movie entitled "Skater Dater" was released, and the first skateboarding magazine titled "The Quarterly Skateboarder" began publishing.

However, the initial craze crashed about 1965. That crash was caused by inferior product combined with reckless skating. The clay wheels used at the time did not grip the road well and thus did not provide a good, safe ride. After several deaths involving skateboarders, a number of cities banned the boards citing health and safety concerns and many manufacturers went out of business. While skateboarding continued in certain areas such as Santa Monica, it was generally a low key, underground activity.

Slowly, improvements were made to the boards. The kicktail and urethane wheels were added circa 1970 thus improving the ride available to the boards. In addition, truck manufacturers began making trucks specifically designed for skateboarding. In the 1970s, precision bearings ended years of problems with the old loose ball bearings. Soon, the sport had regained its popularity. Skateboards grew from about six or seven inches in width to about nine inches thus adding more stability to the product. In view of these improvements, skateboarding has once again become a popular activity.

One of the many modifications made to the trucks is the placement of a soft rubber riser pad between the base of the truck and the skateboard itself Riser pads prevent stress cracks caused by the metal to wood contact between truck and skateboard. In addition, riser pads compact and add resistance to help keep the mounting screws tight and the truck tightly fastened to the skateboard. Lastly, by lifting the skateboard body slightly higher above the wheels, the riser pad prevents most instances of wheel bite wherein the wheel contacts the underside of the skateboard during extreme maneuvers.

However, the soft rubber riser pad of the prior art does cause its own set of problems. Specifically, the soft rubber commonly contacts concrete, wood or other obstacles during certain maneuvers such as rail, ledge or bench sliding. The soft rubber surface does not slide well and thus slows down or stops the slide prematurely. In addition, some of the soft rubber riser pads are locked into place and cannot be adjusted forward or backward at any time.

Further, when executing the more difficult sliding tricks, the urethane wheels connected to the trucks often come into contact with the obstacles such as ledges, rails and benches used for sliding. The soft urethane wheels do not slide well if at all against the obstacle. Such contact often damages those wheels, requiring repair or replacement of same. For purposes of this specification, the term "outboard" refers to those two longitudinal sections of the board which are positioned outside of the two trucks, both rearward and forward of the trucks though the terms rearward and forward are interchangeable with modern skateboards.

One solution to the aforementioned problems is the use of a slide plate as described in U.S. Pat. No. 6,443,471 entitled "Skateboard Truck Assembly" which issued on Sep. 3, 2002 to Mullen. However, the slide plate of Mullen is only built into Mr. Mullen's TENSOR® brand of skateboard trucks and are not adapted for use with any other truck or riser pad.

Thus there is a need for a universal replaceable slider plate apparatus for use with skateboard riser pads or trucks which also provides a greater buffer zone between the truck/wheels friction with any obstacle and thereby eliminate any ledge to soft rubber riser pad contact.

None of the known prior art disclose the combination set forth herein.

SUMMARY OF THE INVENTION

It is an object of this invention to provide a replaceable slide plate for use with riser pads on skateboards which is positioned outboard of the skateboard truck.

It is a further object of this invention to provide elongated oval holes for use with riser pads on skateboards which allows for adjustment of the riser pad forward or backward to fit in place under differing truck bases.

It is a further object of this invention to provide a replaceable slide plate for use with riser pads on skateboards which allows for easier sliding over obstacles and protects the trucks during such sliding.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
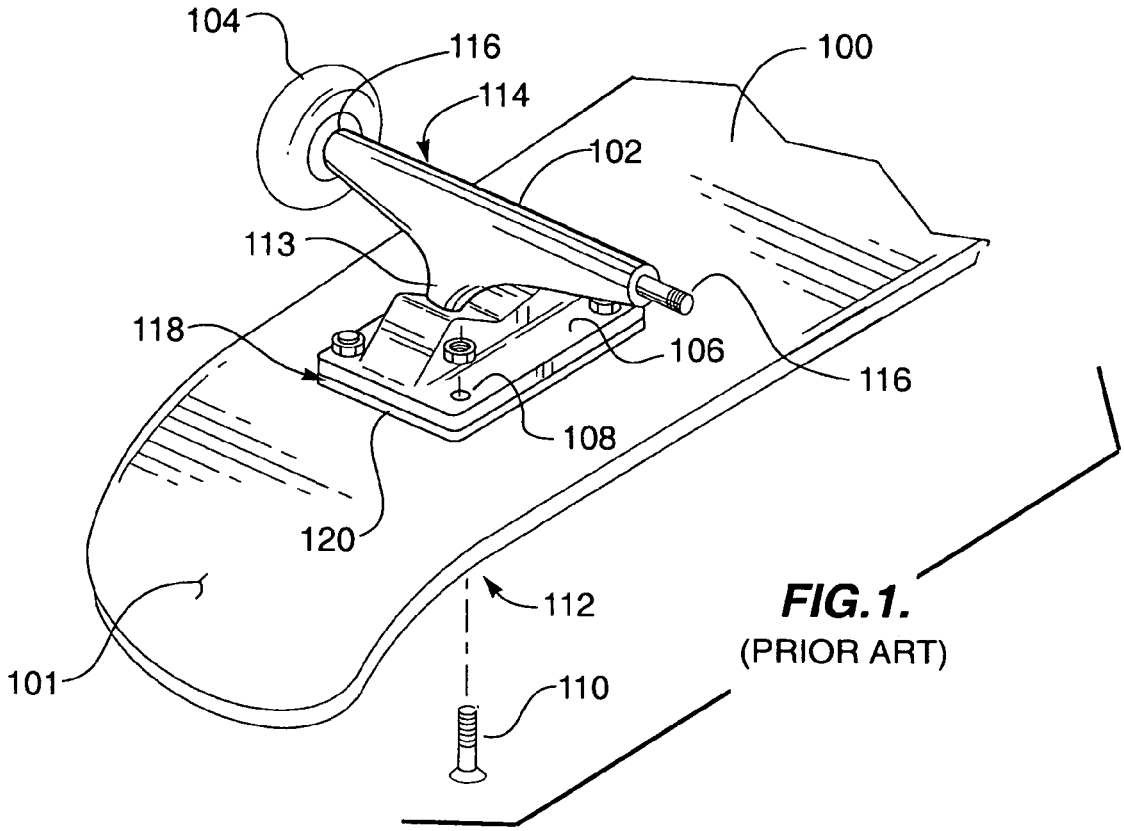
FIG.1. (PRIOR ART)
FIG. 1 is a perspective view of a truck and riser pad of the prior art affixed to a skateboard.

As best seen in FIG. 1, a skateboard 100 of the prior art utilizes a truck 102 of which attaches two wheels 104 to skateboard 100. Generally, skateboard 100 is provided with two trucks 102. Each truck 102 generally comprises a rectangular flat base plate 106 having four holes 108 extending therethrough. Screws 110 extend through corresponding holes 112 in skateboard 100 into holes 108 to mount truck 102 to said skateboard.

Extending longitudinally and opposite skateboard 100 from the middle of flat base plate 106 is an axle mount base 113 which is preferably integral with flat base plate 106. An axle mount 114 is mounted to axle mount base 113 wherein an axle 116 extends laterally therefrom. Wheels 104 are mounted on opposite sides of axle 116. Those skilled in the art will recognize that axle mount 114, axles 116 and flat base plate 106 are mounted and connected to each other in a standard system. However, the present invention does not relate to this interaction and it will not be further discussed herein.

As shown in FIG. 1, interposed between flat base plate 106 and skateboard 100 is a riser pad 118 which is generally a rectangular shape which is adapted to conform to the shape of flat base plate 106. Riser pad 118 is preferably a compressible soft rubber or plastic material. As previously discussed, use of riser pad 118 prevents stress cracks caused by screws 110 as well as contact between metal truck 102 to wooden skateboard 100. In addition, riser pad 118 functions as a washer to keep truck 102 firmly attached to skateboard 100. Lastly, by adding riser pad 118 to increase the separation between skateboard 100 and wheels 104, riser pad 118 helps prevent the chronic problem of wheel bite wherein wheel 104 makes contact with the underside of skateboard 100 during extreme maneuvers thereby stopping wheel 104 and in many cases ejecting the rider from the skateboard 100.

Figure 5A:
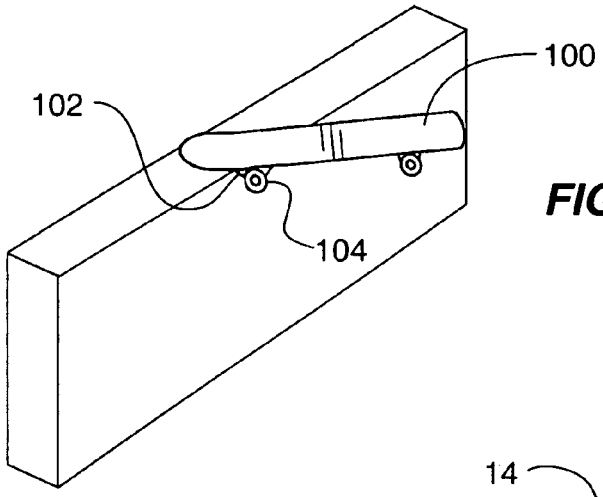
FIGS. 5A and 5B compare the prior art and the present invention when a skateboard is used against a ledge.

However, as also noted in the prior discussion, riser pad 118 can introduce other problems. Specifically, when a rider performs obstacle sliding maneuvers wherein skateboard 100 is slid laterally along a bottom surface 101 positioned longitudinally outboard of trucks 102 ledges, benches or other surfaces, the surface 120 of riser pad 118 facing the direction of bottom surface 101 may contact concrete, wood or other materials as shown in FIG. 5A Since the soft rubber of front surface 120 does not slide well, such contact slows down or stops the slide prematurely. In addition, the soft rubber riser pad 118 is set in small circular holes 108 which does not allow for any adjustments to the positioning of pad 118 during assembly. Further, there is no protection offered for trucks 102 from such contact with ledges by the riser pad 118 of the prior art.

Figure 2:
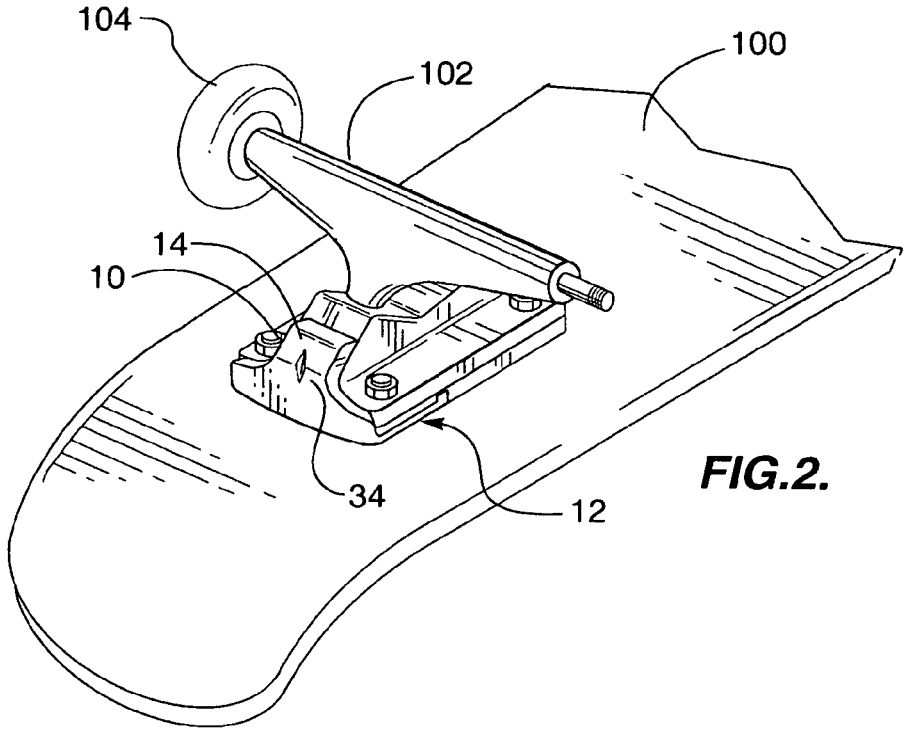
FIG. 2 is a perspective view of the present invention affixed to a skateboard.
Figure 3:
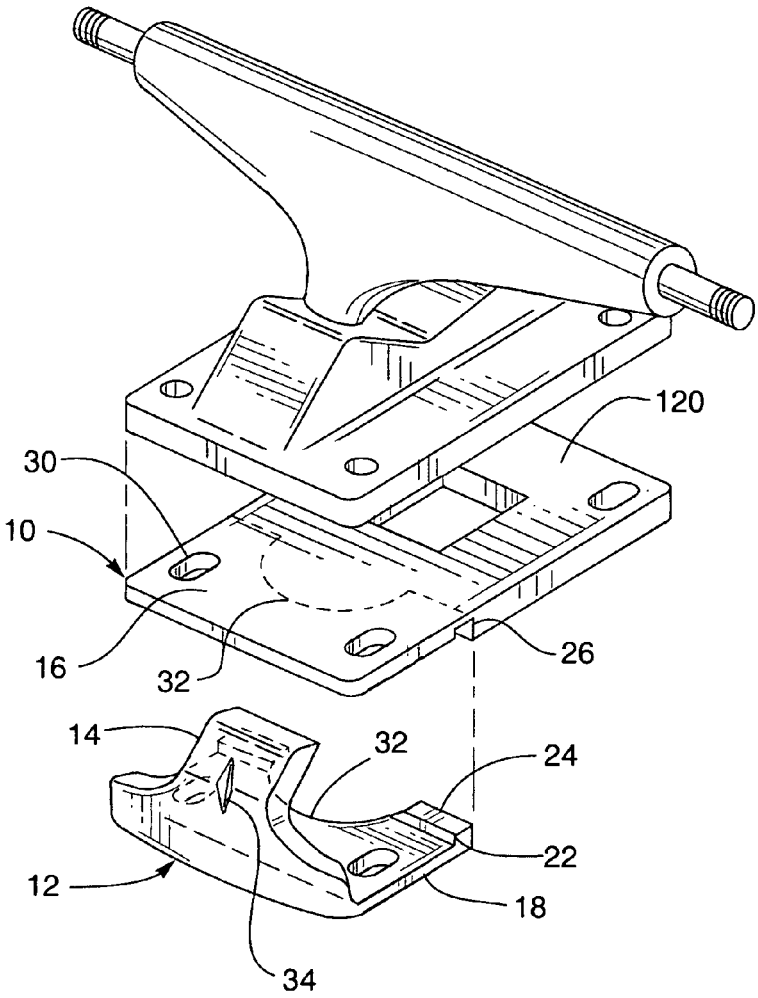
FIG. 3 is an exploded perspective view of the present invention.
Figure 4:
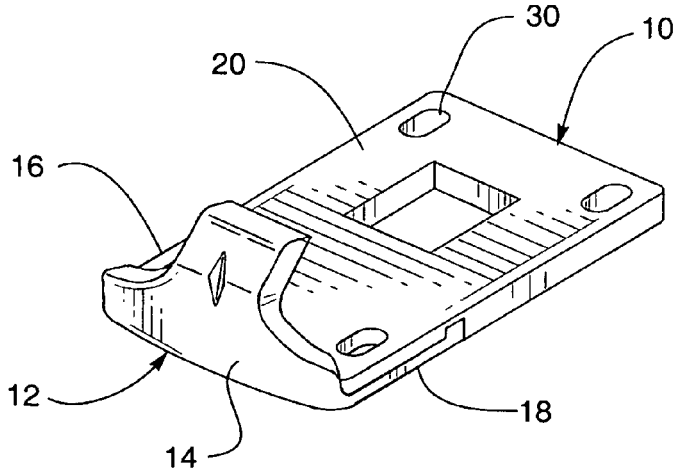
FIG. 4 is a perspective view of the present invention.
Figure 5B:
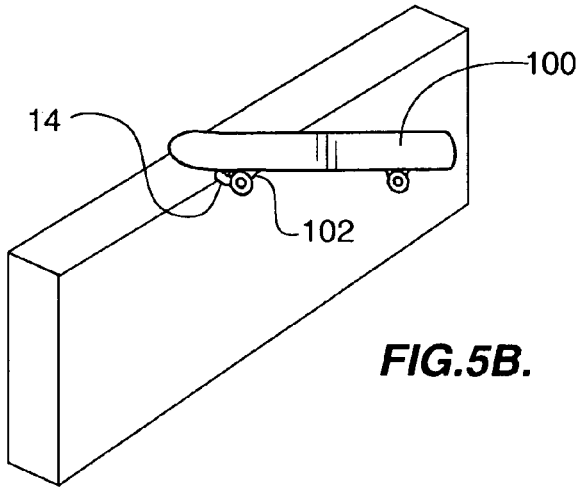

Referring more particularly to the drawings by characters of reference, FIGS. 2–4 disclose a slide plate 12 comprising the present invention. In the presently preferred embodiment, slide plate 12 comprises a front slide piece 14 adapted to engage the outboard side of truck 102. Slide piece 14 is preferably made from a hard material including, but not limited to, plastic or glass filled nylon which slides more easily over an obstacle surface and further protects the outboard surface of truck 102 from damage. In addition, slide piece 14 provides additional separation between truck 102 or /wheels 104 and any obstacle as shown in FIG. 5B.

In the most preferred embodiment, slide plate 12 is adapted to mount to a riser pad 10. Extending from the bottom of front slide piece 14 underneath flat base plate 106 is a horizontal piece 18 which is adapted to mate with a corresponding thin portion 16 of riser pad 10. Horizontal piece 18 and thin portion 16, in combination, are as thick as the remaining thick portion 20 of riser pad 10.

In the presently preferred embodiment, a distal end 22 of horizontal piece 18 is provided with raised squared off portion 24 adapted to engage a corresponding grooves 26 in thin portion 16 of riser pad 10 to prevent relative longitudinal movement of slide piece 14 and riser pad 10 when mounted.

To prevent lateral movement between slide piece 14 and riser pad 10, a half moon shaped recess 32 on horizontal piece 18 mates with a corresponding half moon shaped extension 34 (in shadow) of thick portion 20.

Oval gaps 30 extend through horizontal piece 18 and riser pad 10 correspond to holes 112 in skateboard 100 and are adapted to receive screws 110. The shape of oval gaps 30 whose longer axis is aligned longitudinally, allows longitudinal adjustment of the position of riser pad 10 and slide piece 14 as a whole, for example, when using the present invention with different trucks 102.

On the face of slide piece 14 opposite truck 102, a wear indicator 34 comprising a simple groove is preferably provided. Once wear indicator 34 disappears, the rider knows that slide piece 14 needs replacement.

Figure 6:
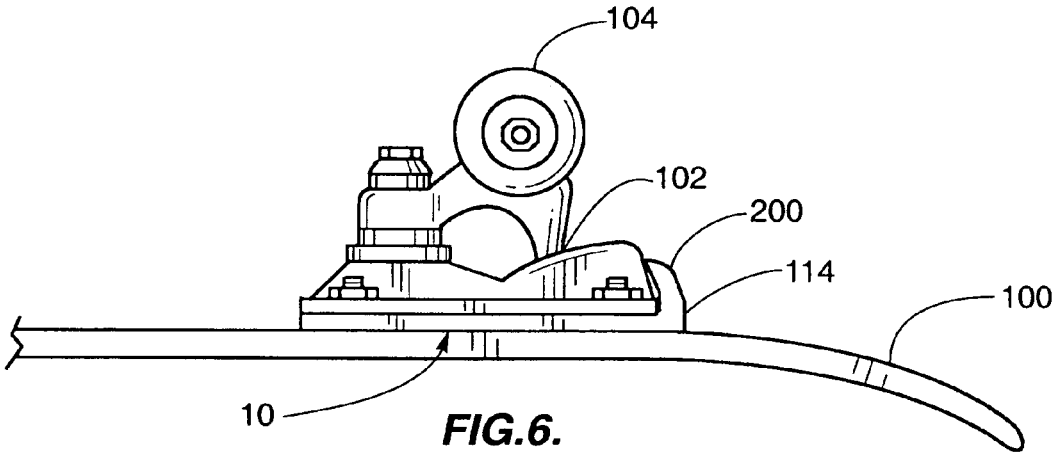
FIG. 6 is a side view of an alternate embodiment of the present invention affixed to a skateboard.

In an alternate embodiment shown in FIG. 6, a unitary construction provides a one piece slide plate and riser pad 200. In this embodiment, riser pad 10 and slide piece 14 are unitary and integral. This embodiment is useful for those users who prefer to have skateboard 100 closer to the ground while still having a small, hard riser pad 10 and slide piece 14.

Although only certain embodiments have been illustrated and described, it will be apparent to those skilled in the art that various changes and modifications may be made therein without departing from the spirit of the invention or from the scope of the appended claims.

What is claimed is:

1. A slide plate adapted for use with a skateboard truck for attaching two wheels to a bottom of a skateboard, the skateboard truck comprising a flat base plate having an axle mount base extending longitudinally and opposite from the skateboard, the skateboard truck further comprising a riser pad conforming to the shape of the flat base plate, the axle mount base having an axle mount affixed thereto, the axle mount having an axle extending laterally therefrom and having a wheel mounted at opposing ends of said axle, the improvement comprising a front slide piece positioned on an outboard side of the truck, the front slide piece having means for longitudinally movement thereof with respect to the skateboard truck, the riser pad being interposed between the flat base plate and the skateboard, the riser pad including a thin portion overlapping the front slide piece and a thick portion, the front slide piece having a horizontal piece which extends laterally therefrom and mates with the thin portion of the riser pad, the thin portion and the horizontal piece in combination being as thick as the thick portion.

2. The slide plate of claim 1 wherein the front slide piece is made from a hard material adapted to slide along obstacles.

3. The slide plate of claim 1 wherein the longitudinal adjustment means comprises four longitudinally oriented oval shaped holes extending through the front slide piece, the four oval shaped holes mating with four corresponding holes in the skateboard, the skateboard truck having four screws extending through the four oval shaped holes and the four corresponding holes to mount the skateboard truck to the skateboard.

4. The slide plate of claim 1 wherein the riser pad is made from a soft, compressible material.

5. The slide plate of claim 1 wherein the horizontal piece has a raised squared off portion engaging corresponding grooves in the thin portion thereby preventing relative longitudinal movement of the horizontal piece and the thin portion.

6. The slide plate of claim 1 wherein the horizontal piece has a half moon shaped recess thereon which mates with a corresponding half moon shaped extension on thin portion thereby preventing lateral movement therebetween.

7. The slide plate of claim 1 having oval gaps extending through the horizontal piece which correspond to the holes in the skateboard, the long axis of the oval gaps being aligned longitudinally thereby allowing longitudinal adjustment of the riser pad and front slide piece.

8. The slide plate of claim 1 wherein the front slide piece includes a wear indicator.

9. The slide plate of claim 8 wherein the wear indicator comprises a groove whereby once said groove disappears, the front slide piece is soon to be replaced.

* * * * *